United States Patent [19]

Perrenoud

[11] Patent Number: 4,463,230

[45] Date of Patent: Jul. 31, 1984

[54] ELECTRIC POWER CIRCUIT BREAKER

[75] Inventor: Blaise Perrenoud, La Neuveville, Switzerland

[73] Assignee: BBC Brown, Boveri & Company, Limited, Baden, Switzerland

[21] Appl. No.: 417,450

[22] Filed: Sep. 13, 1982

[30] Foreign Application Priority Data

Sep. 16, 1981 [CH] Switzerland ..... 5970/81

[51] Int. Cl.[3] ..... H01H 33/18

[52] U.S. Cl. ..... 200/147 R; 200/146 R

[58] Field of Search ..... 200/147 R, 147 A, 147 B, 200/146 R, 146 A

[56] References Cited

U.S. PATENT DOCUMENTS 4,249,051 2/1981 Votta ..... 200/147 R

*Primary Examiner*—E. A. Goldberg
*Assistant Examiner*—Morris Ginsburg
*Attorney, Agent, or Firm*—Burns, Doane, Swecker & Mathis

[57] ABSTRACT

An electric power circuit breaker includes two switching elements which can move, relative to each other, in an extinguishing gas and which contain, in each case, at least one main current contact and at least one arcing contact. A cylindrical coil is connected between the arcing contact and the main current contact of one of the two switching elements. This coil is provided with a ferromagnetic core, as a result of which the magnetic field of the coil exhibits a high field strength at the position occupied by an arc-commutating ring which is connected to the coil. In this circuit breaker, the commutation of heavy currents from the main current path to the coil path is accomplished in a reliable manner at all times and by simple means. This is achieved when the core is installed in a manner permitting its displacement along the axis of the coil. When the circuit breaker is in the circuit making position the core passes through no more than a portion of the interior of the coil. It closes off the interior of the coil and is flush with the arc-commutating ring when the circuit breaker is in the current breaking position.

4 Claims, 2 Drawing Figures

ELECTRIC POWER CIRCUIT BREAKER

BACKGROUND OF THE INVENTION

The present invention relates to an electric power circuit breaker of the type having a pair of main power contacts, a pair of commutation or arcing contacts, and a coil through which the current flows as it passes through the arcing contacts.

A circuit breaker of this type is disclosed, for instance, in Swiss Patent Application No. 3815/80-0. In this circuit breaker, after the main contacts have opened, the current which is to be broken commutates into a current path in which it successively flows through the coil and through the arcing contact of a first switching element. This arcing contact is designed as an arc-commutating ring and is connected to the coil by electrically conducting means. The current then flows through the arcing contact of a second switching element. This contact can move relative to the main power contact. Since the coil through which the current to be interrupted flows is provided with a ferromagnetic core, a powerful magnetic field acts on the arc which forms between the arcing contacts. This magnetic field causes the arc to rotate rapidly around the arcing contact of the first switching element. On the other hand, however, this powerful magnetic field also hinders the commutation of heavy currents from the main current path onto the coil path.

OBJECT AND BRIEF SUMMARY OF THE INVENTION

Accordingly it is an object of the present invention to provide a circuit breaker of the aforementioned type in which the commutation of heavy currents from the main current path onto the coil path is effected in a simple manner with high reliability, and in which a powerful magnetic field acts on the arc simultaneously with the separation of the arcing contacts.

This object is achieved by displacing the ferromagnetic core along the axis of the coil so that during a circuit making operation the core occupies only a portion of the interior of the coil, but in a circuit breaking position it closes off the interior of the coil. These measures enable the current being broken to be commutated from the main current path onto the coil path while the magnetic load is low, and consequently with high reliability, while nevertheless having the full magnetic load available during the separation of the arcing contacts.

In one embodiment of the circuit breaker according to the invention, the core has an annular shape at the end which faces the movable switching element. An advantage results from this design in that the power for driving the movable switching element can be comparatively low, since this switching element has a low mass, on account of its simple construction.

In another feature of the circuit breaker according to the invention, the core member can have an insulating surface. The resulting protection of the arcing contacts located at the coil against excessive burning is particularly effective. The arc occurring during the current breaking process is simultaneously forced onto the arc-commutating ring, even when the current is low.

When the core member forms a portion of the arcing contact and is designed as a nozzle, gas can be blown particularly effectively onto the arc due to the fact that the arrangement of the arcing contacts has advantageous flow characteristics.

On the other hand, by closing off the end of the core member, the volume to be heated is comparatively small, and a vigorous flow of extinguishing gas, and hence a good extinguishing effect, can be obtained even with low current.

Furthermore, by designing the end of the core member that faces away from the movable switching element as a piston, it is possible to obtain effective additional gasblowing onto the arc without having recourse to an external power source.

BRIEF DESCRIPTION OF THE DRAWINGS

In the following text, illustrative examples of the invention are represented, in a simplified form, by means of the drawings, in which.

DETAILED DESCRIPTION

In both Figures, identical parts are marked with identical reference numbers. The circuit making position of the circuit breaker is represented in the left-hand half of the Figure and a circuit breaking phase is drawn in the right-hand half.

Figure 1:
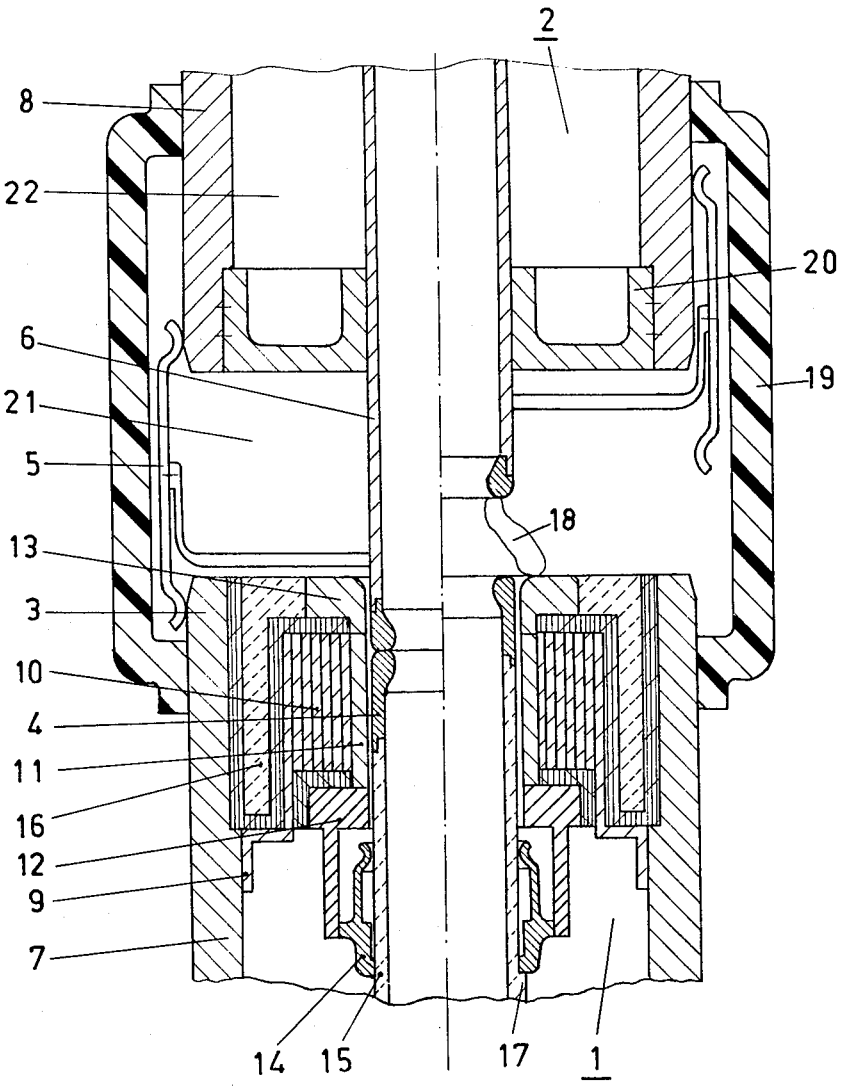
FIG. 1 is a cross-sectional side view, in elevation, of a first embodiment of the circuit breaker according to the invention.

In FIG. 1, a stationary switching element 1 includes a main power contact 3, which is designed to conduct the rated current, and an arcing or commutation contact 4. A movable switching element 2 includes a main contact 5 and an arcing contact 6. The current is fed to the main contacts 3 and 5 via current connections 7 and 8, respectively. Main contact 3 and current connection 7 are connected, via a current conductor 9, to the input terminal of a cylindrical coil 10 which surrounds the arcing contact 4.

The other terminal of the coil 10 is connected via an electrical conductor 11 to a conductor 12, which is composed of a ferromagnetic material, and to an arc-commutating ring 13 which is composed of a material which cannot be magnetized. This ring is attached to that end of the coil 10 which faces the movable switching element 2. The ferromagnetic conductor 12 is connected, via a sliding contact 14, to the arcing contact 4 of the stationary switching element 1. The arcing contact 4 includes a ferromagnetic piece 15 which, together with the ferromagnetic conductor 12 and a further ferromagnetic part 16, forms a magnetic circuit. A gap is provided in the magnetic circuit, at least at the position of the arc-commutating ring 13. Through this gap the magnetic field can leave the coil which is excited by the current being interrupted.

The arcing contact 4 is designed as a nozzle and is installed, jointly with the ferromagnetic piece 15, in a manner permitting their displacement along the axis of the coil 10. In the circuit making position of the circuit breaker, no more than a portion of the arcing contact 4, and hence of the ferromagnetic piece 15, occupies the interior of the coil, while in the current breaking position (compare the right-hand half of FIG. 1), the arcing contact 4, and hence also the ferromagnetic piece 15, pass through the interior of the coil and the contact surface of the arcing contact 4 is flush with the arc-commutating ring 13. At the same time, and also when the circuit breaker is in the circuit making position, the arcing contact 4 is held by a spring (not represented) which, in the circuit making position, generates the contact force when the current is low. Even when the current is much lower than the rated current of the circuit breaker, the contact force is generated essentially by the magnetic force acting on the piece 15, because sufficient current flows through the coil 10, parallel to the main contacts. In the circuit breaking position, the movement of the piece 15 is limited by a stop 17.

The arc 18, which is formed during the current breaking process, burns in a heating volume 21 which is bounded by an insulating wall 19 and a conducting partition 20. This heating volume is filled with an insulating gas, such as, for example, sulfur hexafluoride. The gas, heated by the arc 18, enters an exhaust volume 22 via the arcing contacts 4 and 6, which are designed as nozzles.

The mode of operation of the power circuit breaker illustrated in the drawing is as follows:

In the current making position of the circuit breaker, represented in the left-hand half of FIG. 1, the two main contacts 3 and 5 are in electrically conducting contact with each other, and the two arcing contacts 4 and 6 abut each other end-on. During the current breaking process, the movable switching element 2 is moved upwards and, consequently, the two main contacts 3 and 5 are separated from each other. At the same time, the current which is to be broken is commutated from the main current path onto the coil path. The current now flows from the current connection 7 to the current connection 8, via the current conductor 9 and the coil 10, the ferromagnetic conductor 12, the sliding contact 14, the arcing contacts 4 and 6 and the partition 20. The magnetic field of the coil influences the commutating process only to a slight extent, since the magnetic load of the coil is comparatively low, due to the fact that the ferromagnetic piece 15 occupies only a small portion of the interior of the coil when in the circuit making and commutating position. The arcing contact 4 lags behind the burn-off contact 6 under the influence of the magnetic field of the coil 10. The full load is reached when the arcing contact 4 strikes the sliding contact 14 and closes off the interior of the coil, flush with the arc-commutating ring 13. The arc 18 which is formed by the separating arcing contacts 4 and 6 is subject to the influence of the magnetic field which is generated at the position of the arc-commutating ring 13 by the magnetic circuit, which is now substantially closed. The arc 18 rotates between the arcing contacts 4 and 6, and/or between the arc-commutating ring 13 (which is at the same potential as the arcing contact 4) and the arcing contact 6. During this process, the pressure of the extinguishing gas, which is present in the heating volume 21, rises. The arc 18 is powerfully blown by means of a flow of extinguishing gas which is directed through the nozzle-openings of the arcing contacts 4 and 6 and into the exhaust volume 22.

Figure 2:
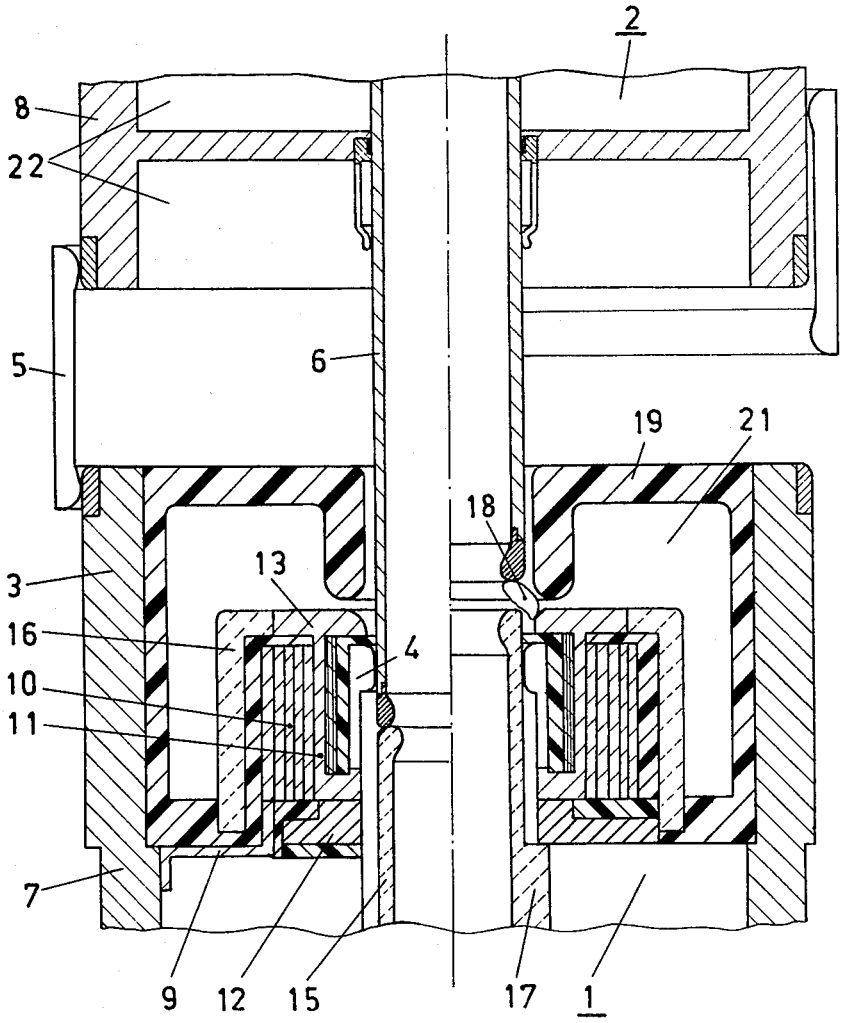
FIG. 2 is a cross-sectional side view, in elevation, of a second embodiment of the circuit breaker according to the invention.

The illustrative embodiment of the power circuit breaker implementing the invention that is represented in FIG. 2 differs from the illustrative embodiment of FIG. 1 essentially by virtue of the fact that the arcing contact 4 is immovably attached to the stationary switching element 1. The arcing contact 6 of the movable switching element 2 passes into the arcing contact 4 when the circuit breaker is in the circuit making position. In addition, the ferromagnetic piece 15 is designed as an insulating follow-up nozzle and contains ferromagnetic material only to a partial extent. The piece 15 can, for instance, contain a ferromagnetic substance, the surface of which is coated with an insulating material, such as, for example, polytetrafluoroethylene.

In this embodiment, the current which is to be broken is commutated, in the same manner as in the illustrative embodiment of FIG. 1, from the main current path onto the coil path at a low value of the magnetic load. During the operation of separating the arcing contacts 4, 6 and forming the arc between these contacts, a powerful magnetic field is available at the position of the arc-commutating ring. This field causes the arc 18 to rotate rapidly and to bring about intense heating of the extinguishing gases in the volume 21. By means of the ferromagnetic piece 15, which is designed to have an insulating function, a geometry which favors the extinguishing process is obtained, and a means of protecting the contact 4 against burn-off is additionally formed.

Instead of designing the arcing contact 4 of the first switching element 1 and/or the ferromagnetic piece 15, which is designed to have an insulating function, as a follow-up nozzle, it is conceivable to close the nozzle-openings of these parts by means of an insulating plug (not shown) which slides into these openings. A particularly effective pressure increase is achieved by this means in the heating volume 21, thus resulting in gas being blown vigorously onto the arc 18, particularly when low currents are being broken. The pressure of the extinguishing gas can also be increased by designing the piece 15, which can be magnetized, in the shape of a piston at its end which faces away from the second switching element 2. This end can slide in a cylinder which is filled with extinguishing gas and which is connected to the heating volume 21 via a passage.

It will be appreciated by those of ordinary skill in the art that the present invention can be embodied in other specific forms without departing from the spirit or essential characteristics thereof. The presently disclosed embodiment is therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. An electric power circuit breaker, comprising:

a pair of relatively movable switching elements each including a main power contact and an arcing contact, said main power contacts and said arcing contacts being movable into and out of engagement with one another, respectively;

a cylindrical coil connected between the main contact and the arcing contact of one of said switching elements;

an arc-commutating ring disposed at the end of said one switching element and facing the arcing contact of the other switching element, said ring being electrically connected to the arcing contact of said one switching element; and a magnetic core within the interior of said coil, said core being comprised at least partially of ferromagnetic material and being displaceable along the axis of said coil such that said core is disposed in only a portion of the interior of the coil when the circuit breaker is in a circuit making position, and is flush with a surface of said ring to close off the interior of the coil when the circuit breaker is actuated.

2. The circuit breaker of claim 1, wherein said core has an annular contact area facing said other switching element, said core being electrically connected to said coil.

3. The circuit breaker of claim 1 wherein said core has an insulating surface.

4. The circuit breaker of claim 2 or 3 wherein said core forms a part of the arcing contact for said one switching element, said arcing contact forming a nozzle.

* * * * *